United States Patent [19]

Ballard et al.

[11] 4,007,247

[45] Feb. 8, 1977

[54] PRODUCTION OF FIBRILS

[75] Inventors: Denis George Harold Ballard; Robert Thomas Murray; George Michael Fingland Jeffs, all of Runcorn, England

[73] Assignee: Imperial Chemical Industries Limited, London, England

[22] Filed: Sept. 20, 1973

[21] Appl. No.: 399,273

[30] Foreign Application Priority Data

Sept. 26, 1972 United Kingdom ..... 43899/72

[52] U.S. Cl. ..... 264/140; 162/157 R; 264/13; 264/205

[51] Int. Cl.[2] ..... D01D 5/04

[58] Field of Search ..... 264/8, 13, 205, 176 F, 264/140; 162/157 R

[56] References Cited

UNITED STATES PATENTS

| | | | |
|---|---|---|---|
| 1,500,931 | 7/1924 | Hooper | 264/8 |
| 1,500,934 | 7/1924 | Hooper | 264/8 |
| 3,227,794 | 1/1966 | Anderson et al. | 264/205 |
| 3,388,194 | 6/1968 | Vinicki | 264/8 |
| 3,467,744 | 9/1969 | Woodell | 264/176 F |
| 3,496,261 | 2/1970 | Parv | 264/176 F |
| 3,504,076 | 3/1970 | Lee | 264/205 |
| 3,549,732 | 12/1970 | Rice | 264/143 |
| 3,719,648 | 3/1973 | Frielink | 264/143 |
| 3,770,856 | 11/1973 | Ueki et al. | 260/34.2 |
| 3,774,387 | 11/1973 | Woodell | 57/140 R |
| 3,808,091 | 4/1974 | Aoki et al. | 162/157 R |
| 3,885,014 | 5/1975 | Fukada et al. | 214/176 F |

*Primary Examiner*—Jay H. Woo
*Attorney, Agent, or Firm*—Cushman, Darby & Cushman

[57] ABSTRACT

Fibrils of thermoplastic polymer, particularly crystalline thermoplastic polymers such as polyethylene and polypropylene, are prepared by forcing a dispersion of heat softened polymer particles in a liquid medium through a pair of opposed co-axial orifices. The liquid medium is preferably aqueous and is pressurized to prevent boiling. The resulting fibrils have some degree of molecular orientation, and may be useful in the production of reinforced paper.

15 Claims, 3 Drawing Figures

PRODUCTION OF FIBRILS

Figure 1:
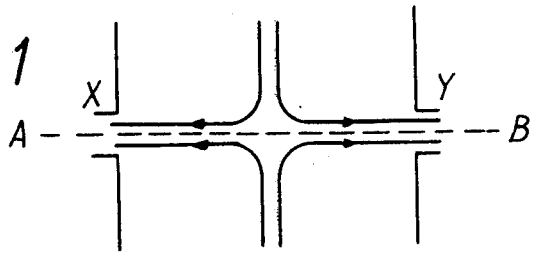

This invention relates to the production of fibrils of thermoplastic polymers, and especially to fibrils of crystallisable polymers in which the polymer chains are highly oriented.

Our invention is especially directed towards the production of fibrils, that is, short fibres, for example, having diameters <25μm, preferably <10μm, and aspect ratios >20 and preferably >100.

Fibrils of polymeric materials may be used to form non-woven sheet materials, e.g. papers, or as reinforcing materials in composites. Preferably they have high molecular orientation.

It has been proposed to produce polyolefin fibrils, e.g. of polyethylene, by high speed agitation or mechanical working of the polymer during or after polymerisation.

We have now devised a process for the production of thermoplastic polymer fibrils which does not necessitate mechanical working of the polymer and, in the case of crystallisable polymers, may produce fibrils having molecular orientation.

According to the present invention we provide a process for the production of fibrils (as hereinbefore defined) of a thermoplastic polymer in which a dispersion of molten or heat-softened particles of the polymer in a liquid medium which is a non-solvent for the polymer under the prevailing conditions is forced through one or more orifices (as hereinafter defined) whereby the polymer particles are elongated into fibrillar form.

The thermoplastic polymer is preferably a crystallisable polymer. Particularly suitable polymers are the polyolefins and copolymers thereof, especially high density polyethylene and isotactic polypropylene. However, our process may also be applied to other thermoplastics, for example polyamides, such as the nylons; polyesters, such as polyethylene terephthalate and polycarbonate; vinylic polymers, such as polyvinylchloride, polystyrene and poly(methylmethacrylate); and fluorinated polymers, such as poly(tetrafluoroethylene), poly(monochlorotrifluoroethylene) and copolymers of tetrafluoroethylene and hexafluoropropylene. Homopolymers and, where appropriate, copolymers of such materials may be used in our process.

It is essential that the liquid medium is a nonsolvent for the polymer at the temperature of the process so that the polymer and liquid remain as two distinct phases throughout the process. Suitable liquids include water and lower alcohols and hydrocarbons. However, it will be appreciated that the choice of liquid medium will be dictated by the nature of the polymer and the temperature of operation of the process. This is especially true of organic media, for example the hydrocarbons, which may be solvents for the polymers at higher temperatures. For this reason, water is a preferred liquid medium in our process. However, it may be advantageous to add water-miscible compounds to the water to modify its viscosity, surface tension, density and/or boiling point.

The dispersion of molten or heat-softened particles of polymer may be conveniently prepared by dispersing solid particles of the polymer in the liquid medium and then raising the temperature of the liquid until the polymer particles melt or soften to the desired extent. Although the polymer particles are preferably molten during our process, it is possible to operate it with heat-softened particles provided that they are sufficiently pliable to be deformed by treatment of the dispersion according to our process.

Since it may be difficult to maintain a stable dispersion of molten polymer for long periods of time, it is often preferred that the dispersion of solid particles is only raised to a temperature at which the particles will melt immediately before passing into the orifice or orifices. In order to stabilise the dispersion of solid particles when aqueous media are used, the addition of a suitable wetting agent is often desirable.

Alternatively, a stabilising agent for the molten polymer dispersion may be added to the liquid medium, in which case the dispersion may be heated to full temperature before it is passed to the orifice or orifices. In this context any suitable surfactant may be used; but a preferred stabilising agent comprises a bi-functional polymeric material part of which is soluble in the liquid medium and part of which is insoluble. It is thought that such a material stabilises the dispersion of molten particles by forming a liquid-medium insoluble coating around the particles which prevents or reduces the tendency of adjacent molten particles to coalesce on coming into contact. An example of such a stabilising material is a copolymer of ethylene oxide and propylene oxide having a molecular weight of about 10,000 or more.

Another way of maintaining a stable dispersion of molten polymer particles involves vigorous mechanical agitation. It will, of course, be appreciated that mechanical agitation may also be used in conjunction with polymeric or other suitable stabilising agents.

It will be appreciated that once the molten or heat-softened particles have been deformed into fibrils, their temperature should be lowered as soon as possible to cause them to solidify and, if molecular orientation has been induced in the fibrils, to ensure that at least some of it is retained. The temperature to which the liquid medium is raised will depend upon the properties of the polymer being processed. For example, the temperature of the liquid medium will generally be in the following ranges during the process when the stated polymers are being processed:

| Polymer | Temp. Range ° C |
|---|---|
| Polyethylene | 140–220 |
| Polypropylene | 170–220 |
| Polyvinylchloride | 100–200 |
| Polystyrene | 150–250 |
| Polyamides | 180–300 |
| Polyesters | 200–350 |

Working at such temperatures will frequently involve maintaining the liquid medium (e.g. water) under elevated pressure to avoid boiling, since it is essential that the medium remains in the liquid state during deformation of the polymer particles. For example, pressures up to 2500 psi or even higher may be used.

The particles of polymer preferably should have diameters in the range 0.1μm to 1000μm; but more preferably they should have diameters of about 1μm to 100μm.

The orifice or orifices used in our process may be jets, preferably or circular cross-section, or slits, provided that the smallest dimension (i.e. diameter of jet or width of slit) is small enough to generate a hydrodynamic field which will cause the particles to be deformed into elongate fibrils. Generally, in the case of circular orifices their diameters are in the range 0.2 to 2.0 mm, but in the case of a slit the smallest dimension may be smaller than 0.2 mm.

Within the term "slit" we wish to include a gap between two spaced surfaces. For example, two circular plates may be spaced apart, face-to-face, to define a narrow gap or slit. A dispersion may then be fed to the gap via a feed pipe passing through the centre of one plate so that it is forced out through the gap in a series of radial paths. It is also possible to force the dispersion through a series of gaps or slits.

The simplest apparatus for carrying out our process comprises a pressure vessel from which the polymer/-liquid dispersion may be forced under pressure through one or more suitable orifices.

However, in order to obtain best results the dispersion should be subjected to a fluid dynamic field having a high longitudinal velocity gradient before entering the orifices. Such a field not only deforms the polymer particles into fibrils, but also imparts a high degree of molecular orientation to the fibrils.

One example of a fluid dynamic field having these characteristics may be generated using the principle postulated by Frank, Keller and Mackley in "Polymer," Vol. 12, p. 467 (1971).

In essence this involves the use of a pressure vessel having a pair of mutually opposed, preferably co-axial, outlet orifices and means for forcing a dispersion of polymer particles in liquid medium, at a suitable temperature, through the opposed orifices simultaneously. Hereinafter for the sake of convenience, such a pressure vessel will be referred to as a "fibrillator." The flow patterns thus induced in the liquid dispersion are represented diagrammatically in accompanying FIG. 1 showing a vessel provided with opposed circular orifices X, Y.

The highest longitudinal velocity gradients occur along the axis of symmetry AB, causing the particles of molten or heat-softened polymer to become elongated into fibrils as they pass along flow paths such as those indicated by the curved arrows in FIG. 1. The precise dimensions and spatial disposition of the orifices may be adjusted to give varying longitudinal velocity gradients in the areas mentioned. For example, when the process is applied to a crystalline thermoplastic polymer, such as high density polyethylene, the arrangement of the orifices should be adjusted to give maximum possible longitudinal velocity gradient so that the fibrils produced have a predominance of a high modulus form of the polymer.

Without prejudice to the invention, it is believed that the fibrils of crystallisable polymer produced by the preferred form of our process (having a diameter of about 1 $\mu$m) comprise a mixture of forms: an extended-chain core of very high modulus (1), surrounded by a less oriented material (2) of much lower modulus. However, ideally, the product has a predominance of the high modulus form.

In one preferred form of our process, a slurry of polymer particles in a non-solvent liquid medium is placed in a stirred pressure vessel and heated to a temperature slightly below the melting or softening point of the polymer. The dispersion so produced is then forced, under nitrogen pressure, into a fibrillator, the body of which is maintained at a temperature above the melting point of the polymer, and forced out through a pair of mutually opposed orifices. The residence time of the dispersion in the fibrillator may be kept to a minimum so that the polymer particles are only molten just before encountering the hydrodynamic field in the fibrillator. In this way, the possibility of coalescence of the molten polymer particles is considerably reduced.

In another form of our process a molten polymer stabilising agent is added to the slurry of solid polymer particles and then the slurry is heated to a temperature at which the polymer is molten in the stirred pressure vessel, the fibrillator being maintained at the same temperature. As previously mentioned, mechanical agitation may be used to stabilise the molten dispersion.

It will be appreciated that the process of our invention may be readily combined with any process by which polymer may be produced in particulate or powdered form. These either may involve polymerisations which give rise to polymer in particulate form, or they may involve a first stage in which polymer is produced in bulk form and is then subjected to a second stage process to transform it to the required particulate form.

Examples of the first-mentioned polymerisations include emulsion polymerisation, for example of polystyrene and the polymerisation of polyolefins using certain organometallic catalysts in liquid or gas phase polymerisation.

When polyolefins are polymerised preferred processes are the so-called "supported" organometallic catalysts which may be of the supported Ziegler type, but preferably comprise a supported transition metal hydrocarbyl catalyst as described and claimed in our British Pat. No. 1,314,828.

For example, dry powdered polymer may be slurried with a suitable non-solvent in a pressure vessel, raised to the appropriate temperature and pressure and forced through an orifice or orifices to form fibrils as described above.

Alternatively, the polymer product may be withdrawn continuously from the polymerisation vessel (usually in the form of a slurry in a hydrocarbon diluent, such as hexane), the diluent removed, e.g. by flash evaporation, and the resultant powdered product slurried with a suitable non-solvent and passed directly to the pressure vessel. Operation in this way provides a continuous process for forming polymer fibrils from monomer. It will be appreciated that it may not be necessary to remove all traces of the hydrocarbon diluent from the polymer before it is slurried with the non-solvent. For example, some of the hydrocarbon diluent (say up to about 1%) may remain in the product during the fibril forming step.

In order to facilitate cooling of the fibrils on issuing from the orifice it is preferable to separate them from the non-solvent liquid phase as soon as possible. This may be readily accomplished by feeding the issuing dispersion on to a mesh or screen having a suitable sized pitch. This enables the bulk of the liquid phase to drain away from the fibrils which remain on the mesh. However, since the liquid phase will normally be under elevated pressure during the fibrillating process, this pressure may conveniently be released on issuing from the orifices thus facilitating rapid evaporation of the liquid phase. It is thus possible to lead the stream of liquid and fibrils from the orifices into an expansion vessel so that liquid evaporates on issuing from the orifices, and a mixture of fibrils in cooled liquid medium collects in the lower part of the expansion vessel.

Should it be desired to use the fibrils produced by our process to make non-woven sheet materials, e.g. papers or the like, the aforementioned mesh may conveniently comprise the Fourdrinier wires of a paper-making machine. Alternatively, the cooled slurry of fibrils in liquid medium may be incorporated in the feed to such a machine. This is particularly convenient when the non-solvent dispersing medium is water, as paper making processes are commonly water-based. The fibrils of our process may be used alone or in combination with other paper-making materials e.g. wood-pulp.

The process of the invention is illustrated by the following Examples.

APPARATUS AND GENERAL PROCEDURE

Figure 2:
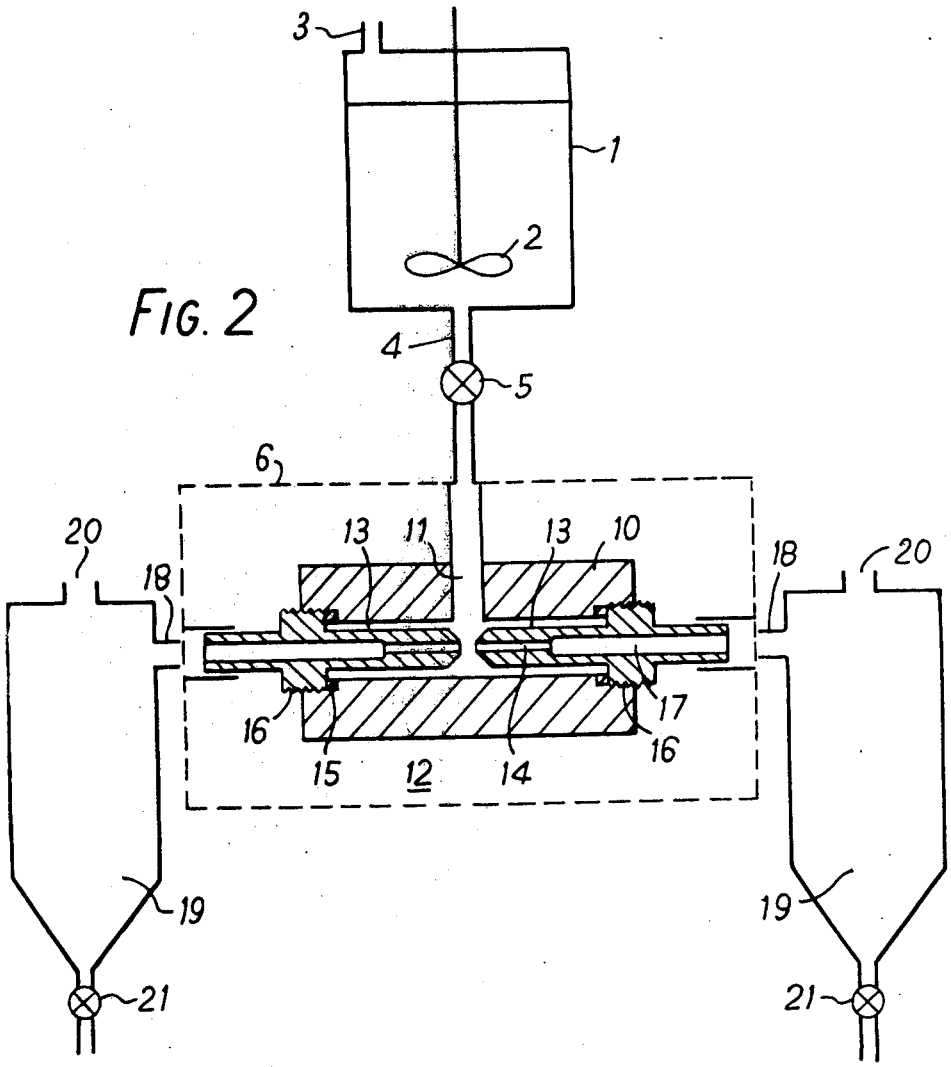

The apparatus used in Examples 1 to 9 comprised a stirred pressure vessel leading to a fibrillator, as illustrated in FIG. 2, which is a cross-sectional elevation of the apparatus. The fibrillator 6 is shown on a larger scale than the remainder of the apparatus for the sake of clarity.

Steel pressure vessel 1 was provided with stirrer 2, electrical heating means (not shown), and inlet and outlet ports 3 and 4, respectively. Inlet port 3 led to a pressurised nitrogen supply (not shown) and outlet port 4 led to fibrillator 6 via valve 5. Fibrillator 6 comprised a rectangular metal pressure vessel 10, heated by electrical means (not shown). A supply passage 11 led to a cylindrical inner chamber 12 which extended at right angles to passage 11 between a pair of opposite faces of the vessel and opened to the faces of the vessel by a pair of internally screw-threaded ports 16 of diameter larger than that of the chamber 12. Two screw-threaded jets 13 were screwed into the ports 16 so as to enter the inner chamber 12, the narrow central bores 14 of the jets constituting a pair of mutually opposed co-axial orifices. The spacing between the jets was adjustable by the insertion of spacers 15 of varying thickness in the ports 16.

Within each jet, the narrow central bore 14 opened out into a passage 17 of larger diameter, the length of the narrow bore 14 constituting the effective length of the jet. The passages 17 communicated with the inlet ports 18 of expansion vessels 19, provided with outlet ports 20 for the escape of the diluent vapour and valves 21 for withdrawal of the suspension of fibrils in cooled liquid medium.

In use, a dispersion of particles of polymer in liquid medium was heated to a temperature a few degrees below the softening point of the polymer, and then forced through the supply passage 11 into the chamber 12 of the fibrillator which was at a much higher temperature, so that the temperature of the polymer was raised above its softening point. The dispersion of heat-softened particles was then forced through the bores 14 of the jets 13, the flow of the liquid medium giving rise to a fluid dynamic field having a high longitudinal velocity gradient. This caused the particles of heat softened polymer to elongate into the form of fibrils which passed through bores 14 and issued from the passages 17 into the expansion vessels 19 as a slurry in superheated liquid medium. Flash evaporation occurred, giving rise to vapour which escaped through outlet ports 20 and cooling the liquid medium to a temperature below the softening point of the polymer.

EXAMPLE 1

An aqueous slurry of high density polyethylene (HDPE) in distilled water was prepared by stirring 25 g. of HDPE (MFI* 0.02, MPt 135° C) with 2500 ml of distilled water and 0.25 g. of surface active agent sodium dioctyl sulphosuccinate (DOSS) in a conical flask. The HDPE was in the form of particles having sizes in the range 10$\mu$m to 1000$\mu$m.

The slurry was then transferred to the stirred pressure vessel of the apparatus illustrated in FIG. 2 of the accompanying drawings, heated to 126°–129° C and pressurised by nitrogen and steam to 225 psi.

The valve at the base of the pressure vessel was then opened and the slurry forced through the fibrillator which had been heated to 250° C, over a period of 60 secs.

The jets of the fibrillator were of 0.80 mm internal diameter, 55 mm long and their adjacent ends were separated by 0.9 mm.

The product collected from the expansion vessels at the exits from the fibrillator jets was subjected to optical and scanning electron microscopy (SEM) and found to contain fibrils having diameters in the range 5–10$\mu$m and aspect ratios in the range 100–200.

SEM examination showed that the fibrils had a rough surface and examination using crossed polar and X-ray diffraction techniques indicated considerable molecular orientation.

A proportion of the polymer feed in this and other Examples was recovered as unmodified particles.

*MFI (melt flow index) in this and Examples 2 to 5 was measured using 2.16 Kg load at 190° C, using procedure defined in ASTM D1238/65T.

EXAMPLE 2

The same general procedure of Example 1 was followed, using a slurry comprising 50 g. of HDPE (MFI 18.3, particle size range 3–100$\mu$m) and 1 g. of DOSS in 2500 ml of distilled water. The slurry was heated to 120° C and pressurised to 225 psi.

For this Example the fibrillator jets had internal diameters of 0.4 mm, were 10 mm long and the adjacent ends were separated by 0.95 mm. The fibrillator was heated to 250° C, and the dispersion passed through the fibrillator in 100 secs.

The product recovered from the expansion vessels included fibrils with diameters in the range 4–10$\mu$m and aspect ratios in the range 50–500 which showed considerable molecular orientation.

EXAMPLE 3

The same general procedure of Example 1 was followed, using a slurry comprising 50 g. of HDPE (MFI 0.35, particle size range 7–130$\mu$m) and 2 g. DOSS in 2500 ml of distilled water. The slurry was heated to 120°–124° C and pressurised to 225 psi.

For this Example the fibrillator jets had an internal diameter of 0.80 mm, were 55 mm long and the adjacent ends were separated by 0.45 mm. The fibrillator was heated to 250° C, and the dispersion passed through in 120 secs.

Fibrils recovered from the expansion vessels had diameters in the range 1–7$\mu$m and aspect ratios in the range 130–900.

EXAMPLE 4

The procedure of Example 2 was repeated but adding 125 g. of polyvinylalcohol to the distilled water used to prepare the polymer slurry. This increased the viscosity of the aqueous medium.

Fibrillator cell had jets of 0.80 mm internal diameter, length 55 mm and separation of 0.90 mm. The fibrillator temperature was 250° C and the dispersion passed through in 180 secs.

Fibrils were produced having diameters in the range 1.5–25μm and aspect ratios in the range 20–300.

EXAMPLE 5

The general procedure of Example 1 was followed, using a slurry comprising 250 g. of HDPE (MFI 0.41, particle size range 5–150μm) and 2 g. of DOSS in 2500 ml of distilled water, the slurry being heated to 122° C at 225 psi.

The fibrillator jets had internal diameters of 0.80 mm, length 55 mm and separation of 0.90 mm. The fibrillator was heated to 250° C and the dispersion passed through it in 120 secs.

The recovered product included fibrils having diameters in the range 5–10μm and aspect ratios of at least 100.

EXAMPLE 6

The general procedure of Example 1 was followed, using polypropylene as starting material. The polypropylene used had an average particle size of 150μm, and a melt flow index of 11 under 10 kg load at 190° C.

A slurry of 50 g. of polymer in 2500 ml of distilled water containing 2 g. of DOSS was heated to 150°–155° C under a pressure of 225 psi and passed through the fibrillator, heated to 260° C, in a period of 180 seconds. The fibrillator jets had diameter 0.80 mm, length 55 mm and separation 0.95 mm.

The recovered product included fibrils having diameters in the range 1.5–25μm, typical aspect ratios of 100–300, and showing considerable molecular orientation.

EXAMPLE 7

The general procedure of Example 1 was followed using a vinyl chloride/vinyl acetate copolymer containing 15% by weight of vinyl acetate units, supplied at "Corvic" (Reg. Trade Mark) R46/88.

A slurry of 50 g. copolymer in 2500 ml of distilled water containing 2 g. DOSS, and containing copolymer particles of size 75–200μm was heated to 122°–132° C under a pressure of 230 psi. The fibrillator jets had diameters 0.80 mm, length 10 mm, separation 0.90 mm. The fibrillator was heated to 250° C, and the dispersion was passed through in 120 seconds.

The recovered product included fibrils having diameters in the range 0.5–15μm and lengths of up to 1 mm.

EXAMPLE 8

The general procedure of Example 1 is followed using a slurry of 250 g. polyethylene terephthalate of particle size 1–25μm in 2500 ml of an aliphatic hydrocarbon diluent of boiling range 220°–250° C.

The slurry is heated to 220° C under 250 psi pressure, and fed to the fibrillator having jet diameters of 0.80 mm length 5.5 mm, separation 0.90 mm and heated to 300° C. The dispersion is passed through the fibrillator in 60 secs.

Fibrils of 0.5–10μm diameter and lengths 20–100μm are obtained.

EXAMPLE 9

The procedure of Example 8 is carried out, the polyethylene terephthalate being replaced by nylon 11 of the same particle size range, dispersed in a hydrocarbon diluent of boiling range 160°–180° C and heated to 160° C under 225 psi pressure. The fibrillator is heated to 250° C, and fibrils of similar size to those of Example 8 are obtained.

EXAMPLE 10

Figure 3:
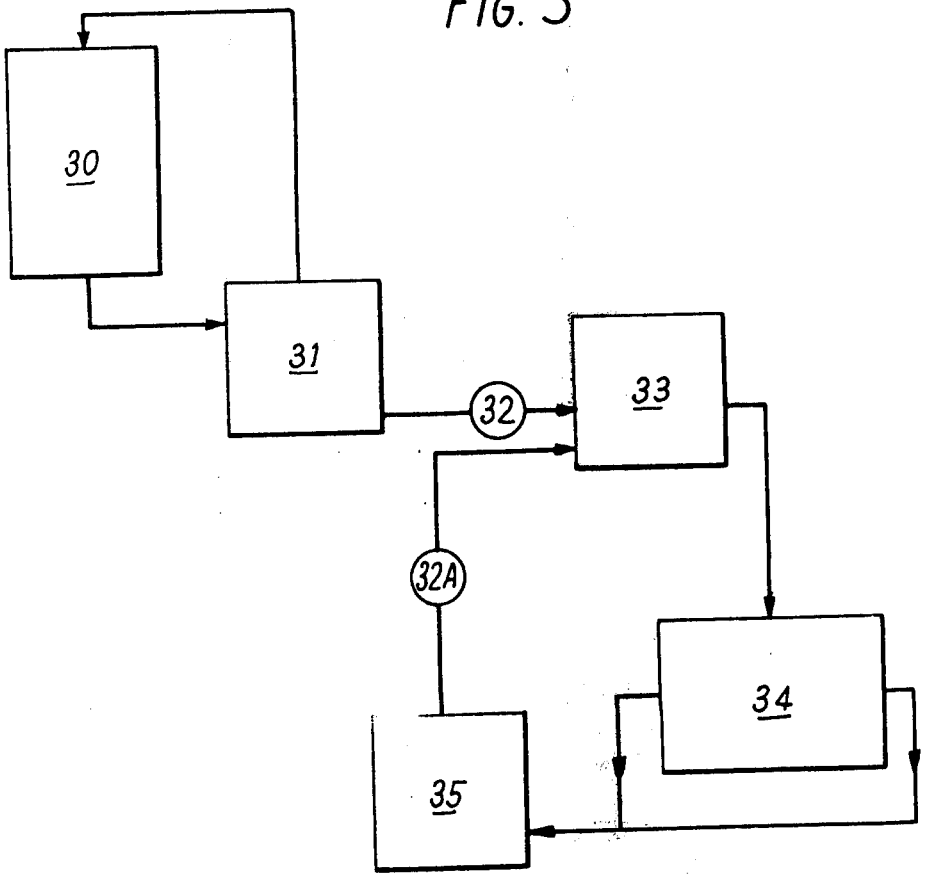

FIG. 3 is a diagrammatic flow sheet of a process for the production of polyethylene fibrils from ethylene. Gaseous ethylene is supplied to stirred reactor 30 and polymerised to granular high density polyethylene by a process using a supported transition metal hydrocarbyl as described in our U. K. Pat. No. 1,314,828. The resultant slurry of polyethylene granules in hydrocarbon diluent is passed to an evaporator 31 to remove at least 99% of the hydrocarbon diluent which is returned to reactor 30. Granular polyethylene from the bottom of evaporator 31 is mixed with water to produce a slurry which is fed under pressure to mixer/melter 33 via compressor 32. The effluent of mixer/melter 33 (dispersed particles of molten polyethylene in water at 180° C) is fed under pressure to fibrillator 34 and the slurry of fibrils produced by passage there through fed to low pressure evaporator 35, causing the water to evaporate as steam which is subsequently condensed and returned to the mixer/melter via compressor 32A. The partly dried polyethylene fibrils are then either passed from evaporator 35 to an additional drier (not shown) or stored as a dispersion in water for further processing.

What we claim is:

1. A process for producing fibrils of a thermoplastic polymer, said fibrils having a diameter <25μm and aspect ratio>20 which comprises subjecting a dispersion of thermoplastic polymer particles in a non-solvent liquid medium in which the polymer is insoluble under the prevailing conditions to a hydrodynamic field having a high longitudinal velocity gradient thereby forming said fibrils at a temperature such that said particles are sufficiently deformable to be elongated into fibrils by the action of said hydrodynamic field.

2. A process according to claim 1 wherein said thermoplastic polymer is selected from the group consisting of polyolefins, polyamides, polyesters, vinylic polymers, fluorinated polymers and copolymers thereof.

3. A process according to claim 2 wherein said thermoplastic polymer is a polyolefin selected from the group consisting of polyethylene, polypropylene and copolymers thereof.

4. A process according to claim 1 wherein the temperature of said dispersion is raised to a point at which the particles will become sufficiently deformable immediately before being subjected to said hydrodynamic field.

5. A process according to claim 1 in which a surfactant is added to the liquid medium to stabilise the deformable polymer dispersion.

6. A process according to claim 5 in which the stabilising agent comprises a bifunctional polymeric material, part of which is soluble and part of which is insoluble in the liquid medium.

7. A process according to claim 1 in which the liquid medium is water.

8. A process according to claim 7 in which the water contains a watermiscible compound which increases the viscosity of the liquid medium.

9. A process according to claim 1 in which the dispersion is heated under pressure to a temperature above the normal boiling point of the liquid medium.

10. A process according to claim 1 in which the thermoplastic polymer is substantially crystalline in the solid state.

11. A process according to claim 10 in which the thermoplastic polymer is high density polyethylene.

12. A process according to claim 10 in which the thermoplastic polymer is polypropylene.

13. A process for the production of fibrils of a thermoplastic polymer according to claim 1, comprising the steps of a. heating a dispersion of solid particles of the polymer in the liquid medium to a temperature below the softening point of the polymer, while maintaining the liquid under sufficient pressure to keep it in the liquid state, b. in a pressure vessel, subjecting the dispersion to a fluid dynamic field having a high longitudinal velocity gradient, said field resulting from the flow of the liquid medium so as to cause elongation of the particles of heat softened polymer into the form of fibrils and forcing the dispersion through a pair of mutually opposed orifices or a narrow gap defined by two spaced surfaces via a feed pipe passing through the center of one of the surfaces, said orifices or feed pipe communicating with the interior of the pressure vessel and, the the dispersion being heated to at least the softening point of the polymer during passage through the vessel, c. cooling the issuing dispersion of fibrils to a temperature below the softening point of the polymer and separating the fibrils from the liquid medium.

14. A process according to claim 13 in which the liquid medium is water.

15. A process according to claim 13 in which the cooling step includes flash evaporation of part of the liquid medium upon release of the applied pressure.

* * * * *

UNITED STATES PATENT OFFICE

CERTIFICATE OF CORRECTION

Patent No. 4,007,247 Dated February 8, 1977

Inventor(s) Denis George Harold Ballard; Robert Thomas Murray; and George Michael Fingland Jeffs It is certified that error appears in the above-identified patent and that said Letters Patent are hereby corrected as shown below:

IN THE HEADING:

At section [30] relating to Foreign Application Priority Data, please correct the application number to read:

--44401/72--.

IN THE CLAIMS:

At column 10, line 13, delete the word "the", third occurrence.

Signed and Sealed this

Fourth Day of October 1977

[SEAL]

*Attest:*

RUTH C. MASON
*Attesting Officer*

LUTRELLE F. PARKER
*Acting Commissioner of Patents and Trademark*